United States Patent [19]

Tomisawa

[11] Patent Number: 4,911,129

[45] Date of Patent: Mar. 27, 1990

[54] AIR/FUEL MIXTURE RATIO CONTROL SYSTEM IN INTERNAL COMBUSTION ENGINE WITH ENGINE OPERATION RANGE DEPENDENT OPTIMUM CORRECTION COEFFICIENT LEARNING FEATURE

[75] Inventor: Naoki Tomisawa, Gunma, Japan

[73] Assignee: Japan Electronics Control Systems Company, Ltd., Isezaki, Japan

[21] Appl. No.: 171,022

[22] Filed: Mar. 18, 1988

[30] Foreign Application Priority Data

Mar. 18, 1987 [JP] Japan ..... 62-61246

[51] Int. Cl.[4] ..... F02D 41/14

[52] U.S. Cl. ..... 123/489; 123/480

[58] Field of Search ..... 123/489, 480, 486; 364/431.05

[56] References Cited

U.S. PATENT DOCUMENTS

| | | | |
|---|---|---|---|
| 4,306,529 | 12/1981 | Chiesa et al. | 123/489 |
| 4,345,561 | 8/1982 | Konda et al. | 123/440 |
| 4,365,299 | 12/1982 | Kondo et al. | 123/489 |
| 4,430,976 | 2/1984 | Kondo et al. | 123/480 |
| 4,498,445 | 2/1985 | Hasegawa et al. | 123/489 |
| 4,517,948 | 5/1985 | Kaji et al. | 123/489 |

FOREIGN PATENT DOCUMENTS

| | | | |
|---|---|---|---|
| 58-77153 | 5/1983 | Japan . | |
| 59-63328 | 4/1984 | Japan | 123/489 |
| 59-136535 | 8/1984 | Japan . | |
| 60-69242 | 4/1985 | Japan . | |
| 2054212 | 2/1981 | United Kingdom . | |

OTHER PUBLICATIONS

SAE Paper No. 860594, 1986, pp. 3.733–3.741, "Development of a High-Speed High-Precision Learning Control System for the Engine Control", Naoki Tomisawa, Horomasa Kubo and Shoji Furuhashi.

*Primary Examiner*—Andrew M. Dolinar

*Attorney, Agent, or Firm*—Foley & Lardner, Schwartz, Jeffery, Schwaab, Mack, Blumenthal & Evans

[57] ABSTRACT

An air/fuel ratio control system employs an altitude dependent learnt uniform correction coefficient which is applicable for all engine driving range and another engine driving range based correction coefficient learnt with respect to responsive engine driving range. The uniform correction coefficient is cyclically updated on engine driving range based correction coefficient. The control system performs FEEDBACK mode air/fuel ratio control with the learnt uniform correction coefficient and the engine driving range based correction coefficient. On the other hand, the control system performs OPEN LOOP mode air/fuel ratio control with the learnt uniform correction coefficient.

38 Claims, 10 Drawing Sheets

AIR/FUEL MIXTURE RATIO CONTROL SYSTEM IN INTERNAL COMBUSTION ENGINE WITH ENGINE OPERATION RANGE DEPENDENT OPTIMUM CORRECTION COEFFICIENT LEARNING FEATURE

BACKGROUND OF THE INVENTION

1. Field of the Invention

The present invention relates generally to an air/fuel mixture ratio control system for an internal combustion engine. More specifically, the invention relates to a learning control system for controlling air/fuel ratio in a fuel injection internal combustion engine, which air/fuel ration control includes lambda ($\gamma$) control for performing FEEDBACK or CLOSED LOOP control on the basis of oxygen concentration contained in an exhaust gas. Further particularly, the invention relates to an air/fuel ratio learning control system which can precisely adjust air/fuel ratio depending upon density of air to be introduced for forming the air/fuel mixture.

2. Description of the Background Art

In the recent years, there have been proposed various air/fuel control systems for internal combustion engines. Some of the recently developed air/fuel ratio control systems incorporate a learning control feature to continuously update a correction coefficient for correcting a basic fuel injection amount based on oxygen concentration in an exhaust gas in order to maintain the air/fuel ratio at a stoichiometric value. In the case of the air density dependent air/fuel ratio, the correction coefficient may be uniformly updated based on an oxygen concentration indicative sensor signal value (hereafter $O_2$ sensor signal) regardless of the engine driving range, in theory. However, in practice, because of tolerance in fuel injection valves, throttle body and other engine components, which causes deviation between an arithmetically obtained basic fuel injection amount and practically required fuel injection amount, uniformly updating or learning of the correction coefficient regardless of engine driving range is practically not possible. By this, it is practically required to set a learnt correction coefficient for each respective engine driving range.

In view of this, learning control systems with a FEEDBACK control feature for controlling air/fuel ratio have been recently proposed in the Japanese Patent First (unexamined) Publication (Tokkai) Showa No. 60-90944 and the Japanese Patent First Publication (Tokkai) Showa No. 61-190142. In the disclosed system, a basic fuel injection amount is derived on the basis of a preselected basic fuel injection control parameter or parameters, such as intake air flow rate, engine revolution speed and so forth. The basic fuel injection amount thus derived is modified employing a feedback correction coefficient which is derived on the basis of an oxygen sensor in an exhaust system and composed of a proportional (P) component and an integral (I) component. By modifying the fuel injection amount on the basis of the feedback correction coefficient, the air/fuel ratio can be FEEDBACK controlled toward a stoichiometric value. Furthermore, the disclosed system derives a learnt correction coefficient with respect to mutually distinct engine operation ranges. In practice, the learnt correction coefficient is determined by deriving a difference between the feedback correction coefficient and a predetermined reference value. This learnt correction coefficient is used in OPEN LOOP mode air/fuel ratio control to derive the fuel injection amount The learnt correction coefficient may also be used in the FEEDBACK or CLOSED LOOP mode air/fuel ratio control together with the feedback correction coefficient.

Such system assures performance of the air/fuel ratio control in the FEEDBACK mode operation to maintain the air/fuel ratio precisely at the stoichiometric value. Furthermore, the learnt correction coefficient may serve to maintain a desired air/fuel ratio even in an OPEN LOOP mode operation.

However, in the aforementioned type of learning control system, a drawback may be encountered in an engine driving condition where the engine driving or operation range frequently fluctuates. For example, in hill or mountain climbing, the air/fuel ratio control is held in a transition mode condition between the FEEDBACK mode and the OPEN LOOP mode to too frequently change the engine driving range to update the learnt correction coefficient during FEEDBACK mode operation. Therefore, the learnt correction coefficient may not reflect the instantaneous air density. This causes a delay in the FEEDBACK mode control after the driving condition returns to a stable state satisfying the FEEDBACK condition. Furthermore, in the OPEN LOOP control, the air/fuel ratio tends to deviate far from the stoichiometric value to degrade drivability.

SUMMARY OF THE INVENTION

Therefore, it is an object of the present invention to provide an air/fuel ratio control system with self-learning feature, which solves the drawback in the prior proposed systems.

Another and more specific object of the invention is to provide a learning air/fuel ratio control system which can update an altitude dependent learnt correction coefficient even in an unstable engine driving condition.

In order to accomplish the aforementioned and other objects, an air/fuel ratio control system, according to the invention, employs an altitude dependent learnt uniform correction coefficient which is applicable for all engine driving ranges and another engine driving range based correction coefficient learnt with respect to respective engine driving ranges. The uniform correction coefficient is updated using an engine driving range based correction coefficient. According to one aspect of the invention, an air/fuel ratio control system for controlling a mixture ratio of an air/fuel mixture to be introduced into a combustion chamber in an internal combustion engine, comprises an air/fuel mixture induction system for introducing intake air and fuel for forming an air/fuel mixture to be supplied into an engine combustion chamber, the air/fuel mixture delivery system incorporating a fuel metering means for delivering a controlled amount of fuel, a first sensor means for monitoring a preselected basic first engine operation parameter to produce a first sensor signal indicative thereof, a second sensor means for monitoring an air/fuel mixture ratio indicative parameter for producing a second variable sensor signal variable indicative of a deviation from a threshold value representative of a stoichiometric value, third means for deriving a basic fuel metering amount on the basis of the first sensor signal value, fourth means for deriving a variable air/fuel ratio dependent correction factor depending upon the second sensor signal value, fifth means for deriving a correction coefficient for air/fuel ratio dependent correction of the basic fuel metering amount which correction coefficient includes a first component which is commonly applicable for correction of the basic fuel metering amount over all engine driving ranges and a second component containing a plurality of mutually distinct individual correction coefficient indicative values respectively set with respect to corresponding engine driving ranges, the fifth means detecting an instantaneous engine driving range on the basis of the first sensor signal value and deriving the individual correction coefficient based on the correction factor for updating a previously set one of the individual correction coefficient indicative values corresponding to detailed engine driving ranges, the fifth means cyclically deriving an updating value for the first component and updating the latter with the updating value, and a sixth means for correcting the basic fuel metering amount with the correction coefficient to control the fuel metering means for delivering the fuel in the amount corresponding to the corrected fuel metering amount to the air/fuel mixture delivery system.

According to another aspect of the invention, an air/fuel ratio control system for controlling a mixture ratio of an air/fuel mixture to be introduced into a combustion chamber in an internal combustion engine, comprises an air/fuel mixture induction system for introducing intake air and fuel for forming an air/fuel mixture to be supplied into an engine combustion chamber, the air/fuel mixture delivery system incorporating a fuel metering means for delivering a controlled amount of fuel, a first sensor means for monitoring a preselected basic first engine operation parameter to produce a first sensor signal indicative thereof, a second sensor means for monitoring an air/fuel mixture ratio indicative parameter for producing a second variable sensor signal indicative of a deviation from a threshold value representative of a stoichiometric value, third means for deriving a basic fuel metering amount on the basis of the first signal value, fourth means for deriving a variable air/fuel ratio dependent correction factor depending upon the second sensor signal value, fifth means for deriving a correction coefficient for air/fuel ratio dependent correction of the basic fuel metering amount which correction coefficient includes a first component which is commonly applicable for correction of the basic fuel metering amount over all engine driving ranges and a second component containing a plurality of mutually distinct individual correction coefficient indicative values respectively set with respect to corresponding engine driving range, the fifth means detecting an instantaneous engine driving range on the basis of the first sensor signal value and deriving the individual correction coefficient based on the correction factor for updating a previously set one of the individual correction coefficient indicative values corresponding to detecting engine driving range, the fifth means deriving an updating value for the first component with a predetermined updating interval on the basis of individual correction coefficient indicative values occurring in the updating interval and distribution thereof over various engine driving range and updating the latter with the updating value, and a sixth means for correcting the basic fuel metering amount with the correction coefficient to control the fuel metering means for delivering the fuel in the amount corresponding to the corrected fuel metering amount to the air/fuel mixture delivery system.

The air/fuel ratio control system may further comprise a detector means detective of engine driving condition satisfying a predetermined feedback control condition for producing a feedback condition indicative signal, the fifth means operates in feedback mode for correcting the basic fuel metering amount with the first and second components of the correction coefficient and operates in open loop mode for correcting the basic fuel metering amount with the first component when the feedback condition indicative signal is absent. The fourth means may be active in presence of the feedback condition indicative signal to cyclically derive the correction factor, and the fifth means is active for deriving the individual correction coefficient indicative value on the basis of the correction factor only when the feedback condition indicative signal is present. The fourth means samples upper and lower peak values of the second sensor signal value for deriving the correction factor by averaging the upper and lower peak values.

On the other hand, third means operates cyclically and derives the correction factor when the engine driving range is held at one of the ranges over a predetermined cycle. The third means incorporates a counter means counting up occurrences of variation of the second sensor signal value across the threshold value during the period in which the engine driving range is held at one of the ranges and is responsive to the counter value of the counter means greater than a given value to derive the correction factor. The third means is responsive to changes of the engine driving range for clearing the counter value. The first sensor means monitors an engine speed indicative parameter and an engine load indicative parameter so that the third means derives the basic fuel metering amount on the basis of the engine speed indicative parameter and the engine load indicative parameter, and the fifth means detects the engine driving range on the basis of the engine speed and the basic fuel metering amount. In practice, the first sensor means monitors a throttle valve angular position and derives the engine load indicative parameter on the basis of the throttle valve angular position and the engine speed.

The air/fuel ratio control system further comprises a timer means triggered by detection of an open loop condition to switch the control mode from feedback mode control to open loop mode control for providing delay in switching control mode from feedback mode control to open loop control.

On the other hand, the correction factor is composed of a proportional component and an integral component, and the fourth means adjusts the proportional component and the integral component is adjusted on the basis of the value of the second sensor signal value for adjusting the air/fuel ratio of the air/fuel mixture at a stoichiometric value represented by the threshold value. The fourth means adjusts the proportional component only when the second sensor signal value varies across the threshold value and otherwise adjusts the integral component.

According to a further aspect of the invention, an air/fuel ratio control system for an internal combustion engine comprises an air/fuel mixture delivery system for introducing intake air and fuel for forming an air/fuel mixture for an engine combustion chamber, the air/fuel mixture delivery system incorporating a fuel metering means for delivering a controlled amount of fuel, a first sensor means for monitoring a preselected basic first engine operation parameter to produce a first sensor signal indicative thereof, a second sensor means for monitoring an air/fuel mixture ratio indicative parameter for producing a second sensor signal indicative of a deviation from a threshold value representative of a stoichiometric value, third means for deriving a basic fuel metering amount on the basis of the first sensor signal value, fourth means for deriving a first correction coefficient for correcting the basic fuel injection amount on the basis of the second sensor means, fifth means for deriving a second correction coefficient which is composed of a first common component constituted by a single correction coefficient and a second individual component constituted of a plurality of mutually distinct correction coefficients adapted for respectively different engine driving range, a sixth means for correcting the basic fuel metering amount by the second correction coefficients to control the fuel metering means for delivering the fuel in the amount corresponding to the corrected fuel metering amount to the air/fuel mixture delivery system, a seventh means for detecting the engine driving range on the basis of the first sensor signal value and updating corresponding one of correction coefficient in the second individual component and set with respect to detected engine driving range, in relation to the first correction coefficient, and eighth means for modifying the first common component of the second correction coefficient with most frequently occurring one of correction coefficient in the second individual component, at a given timing.

BRIEF DESCRIPTION OF THE DRAWINGS

The present invention will be understood more fully from the detailed description given herebelow and from the accompanying drawings of the preferred embodiment of the invention, which, however, should not be taken to limit the invention to the specific embodiment but are for explanation and understanding only.

In the drawings.

DESCRIPTION OF THE PREFERRED EMBODIMENT

Figure 1:
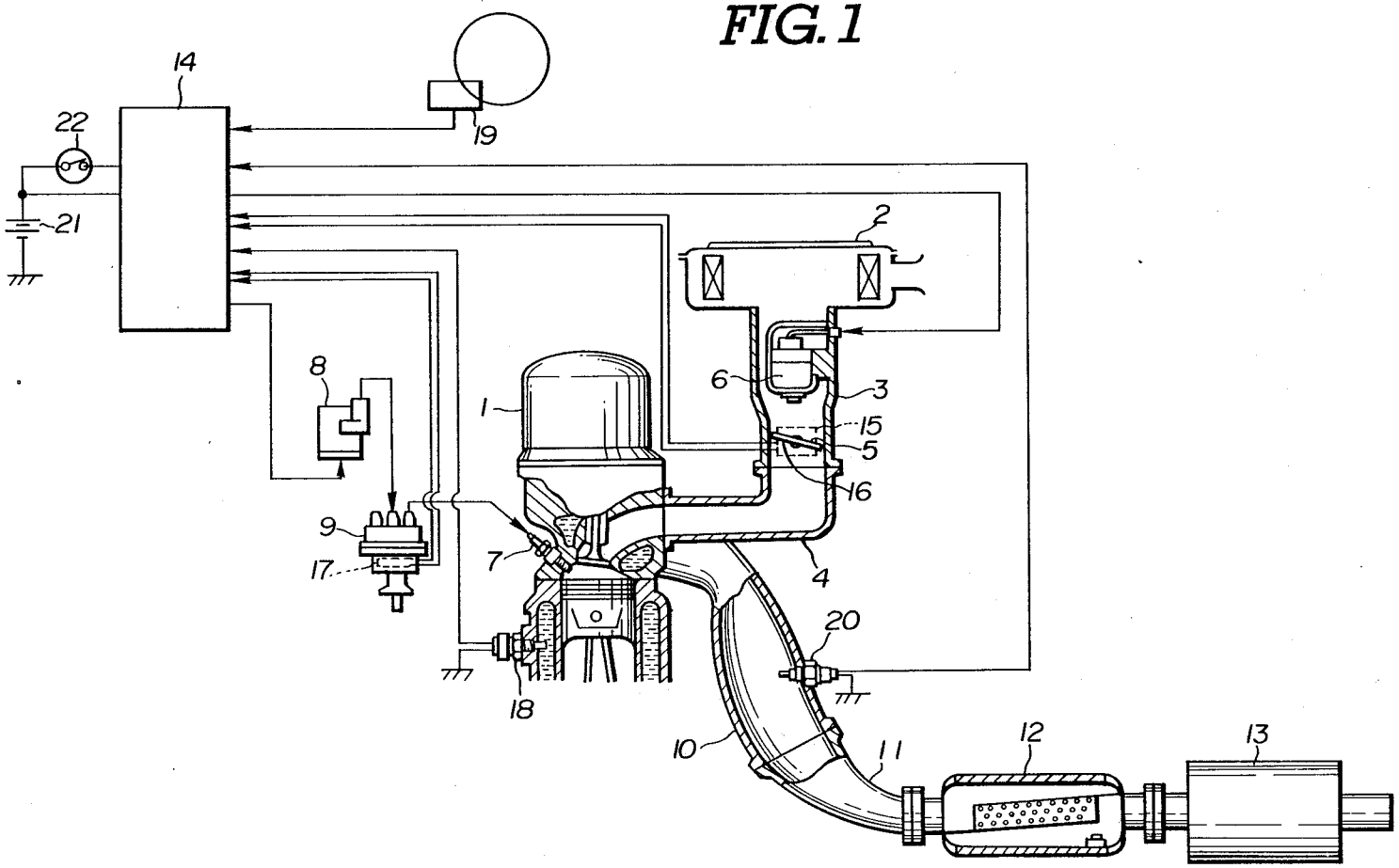
FIG. 1 is a diagram of the preferred embodiment of a learning air/fuel ratio control system according to the invention.
Figure 2:
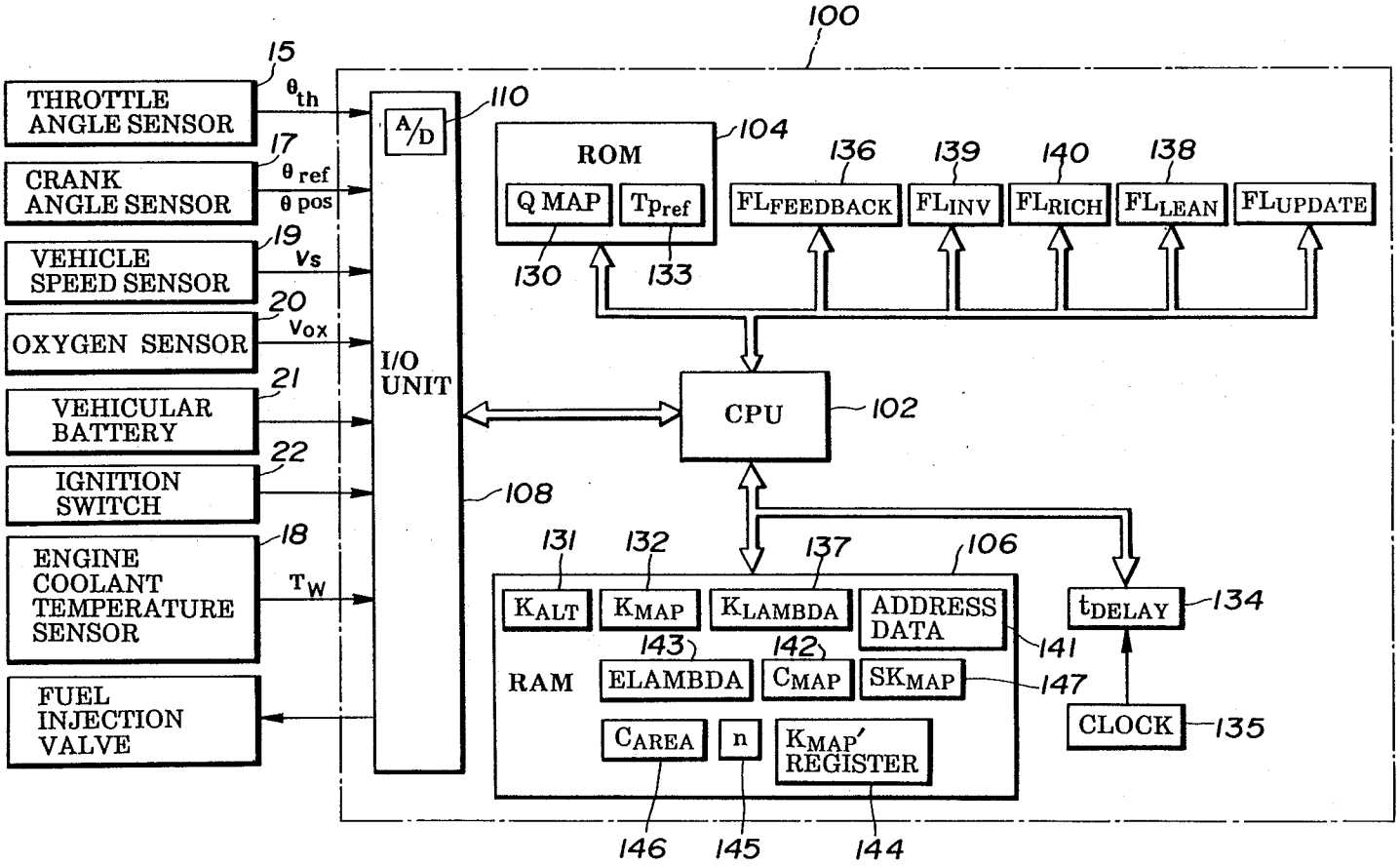
FIG. 2 is a block diagram of a control unit employed in the preferred embodiment of the air/fuel ratio control system of the invention.

Referring now to the drawings, particularly to FIGS. 1 and 2, the preferred embodiment of an air/fuel ratio control system, according to the invention, is applied to a fuel injection internal combustion engine which is generally represented by the reference numeral "1". The engine 1 has an air induction system including an air cleaner 2, a throttle body 3 and an intake manifold 4. A throttle valve 5 is disposed within the throttle body 3 for adjusting induction rate of an air/fuel mixture.

In the shown embodiment, a fuel injection valve 6 is disposed within the throttle body 3 and upstream of the throttle valve 5. Therefore, the air/fuel mixture is formed at the position in the induction system upstream of the throttle valve. The air/fuel mixture flows through the throttle body 3 and introduced into an engine combustion chamber via the intake manifold 4 and an intake port which is open and closed by means of an intake valve.

The air/fuel mixture introduced into the engine combustion chamber is combustioned by spark ignition taken place by means of an ignition plug 7 which receives an ignition power from an ignition coil unit 8 via a distributor 9.

The engine 1 also has an exhaust system including an exhaust manifold 10, an exhaust duct 11, a catalytic converter unit 12 and a muffler 13.

In order to monitor the angular position of the throttle valve 5, a throttle angle sensor 15 is associated with the throttle valve 5 to produce a throttle angle indicative signal 8th having a value indicative of the monitored throttle angle. In practice, the throttle angle sensor 15 comprises a potentiometer producing analog form throttle angle indicative signal having a voltage variable depending upon the throttle valve angular position. Also, an an engine idling condition detector switch 16 is associated with the throttle valve 5 for detecting fully closed or approximately fully closed position of the throttle valve. The engine idling condition detector switch 16 outputs an engine idling condition indicative signal IDL which is held LOW level while the throttle valve 5 is not in fully closed or approximately fully closed position and is held HIGH level while the throttle valve is maintained at fully closed or approximately fully closed position.

A crank angle sensor 17 is coupled with the distributor 9 for monitoring a crank shaft angular position. For this, the crank angle sensor 17 has a rotary disc which is so designed as to rotate synchroneously with rotation of a rotor of the distributor. The crank angle sensor 17 produces a crank reference signal $0_{ref}$ at each of predetermined angular position and a crank position signal $\theta_{pos}$ at every time of predetermined angle of angular displacement of the crank shaft. In practice, the crank reference signal is generated every time the crank shaft is rotated at an angular position corresponding on 70° or 66° before top-dead-center (BTDC) in compression stroke of one of engine cylinder. Therefore, in case of the 6-cylinder engine, the crank reference signal $\theta_{ref}$ is produced at every 120° of the crank shaft angular displacement. On other hand, the crank position $\theta_{pos}$ is generated every given angular displacement, i.e. 1° or 2°, of the crank shaft.

An engine coolant temperature sensor 18 is disposed within an engine cooling chamber to monitor a temperature of an engine coolant filled in the cooling chamber.

The engine coolant temperature sensor 18 is designed for monitoring the temperature of the engine coolant to produce an engine coolant temperature indicative signal Tw. In practice, the engine coolant temperature sensor 18 produces an analog form signal having a voltage variable depending upon the engine coolant temperature condition. A vehicle speed sensor 19 monitors a vehicle speed for producing a vehicle speed indicative signal Vs. Furthermore, the shown embodiment of the air/fuel ratio control system includes an oxygen sensor 20 disposed in the exhaust manifold 10. The oxygen sensor 20 monitors oxygen concentration contained in the exhaust gas to produce an oxygen concentration indicative signal $V_{ox}$ indicative of the monitored oxygen concentration. The oxygen concentration indicative signal $V_{ox}$ is a voltage signal variable of the voltage depending upon the oxygen concentration. In practice, the voltage of the oxygen concentration indicative signal varies across a zero voltage depending on rich and lean of the air/fuel ratio relative to a stoichiometric value.

In addition, the preferred embodiment of the air/fuel ratio control system, according to the invention, has a control unit 100 which comprises a microprocessor. The control unit 100 is connected to a vehicular battery 21 to receive power supply therefrom. An ignition switch 22 is interposed between the control unit 100 and the vehicular battery 21 to establish and block power supply.

As shown in FIG. 2, the control unit 100 comprises CPU 102, RAM 104, ROM 106 and an input/output unit 108. The input/output unit 108 has an analog-to-digital converter 110 for converting analog inputs, such as the throttle angle indicative signal $\theta_{th}$, the engine coolant temperature indicative signal Tw and so forth, into digital signals.

The control unit 100 receives the throttle angle indicative signal $\theta_{th}$, the engine idling position indicative signal IDL, the crank reference signal $\theta_{ref}$, the crank position signal $\theta_{pos}$, the engine coolant temperature indicative signal Tw, the vehicle speed indicative signal Vs and oxygen concentration indicative signal $V_{ox}$. The control unit 100 derives an engine revolution speed data N on the basis of a period of the crank reference signal $\theta_{pos}$. Namely, the period of the crank reference signal $\theta_{ref}$ is inversely proportional to the engine speed, the engine speed data N can be derived from reciprocal of the period of the crank reference signal $\theta_{re}$. Also, the control unit 100 projects an intake air flow amount indicative data Q on the basis of the throttle angle position indicative signal value $\theta_{th}$.

Although the shown embodiment projects the intake air flow rate indicative data based on the throttle angle position indicative signal, it is, of course, possible to obtain the air flow rate indicative data Q directly by a known air flow meter. In the alternative, the intake air flow rate indicative data may also be obtained from intake vaccum pressure which may be monitored by a vaccum sensor to be disposed within the induction system.

Generally, the control unit 100 derives a basic fuel injection amount or a basic fuel injection pulse width Tp on the basis of the engine speed data N and the intake air flow rate indicative data Q which serves to represents an engine load. The basic fuel injection amount Tp is corrected by a correction factors derived on the basis of the engine coolant temperature Tw, the rich/lean mixture ratio indicative oxygen concentration indicative signal $V_{ox}$ of the oxygen sensor 20, a battery voltage and so forth, and an enrichment factor, such as engine start up enrichment factor, acceleration enrichment factor. The fuel injection amount modified with the correction factors and enrichment factors set forth above, is further corrected by a air/fuel ratio dependent correction coefficient derived on the basis of the oxygen concentration indicative signal $V_{ox}$ for adjusting the air/fuel ratio toward the stoichiometric value.

The practical operation to be performed in the control unit 100 of the preferred embodiment of the air/fuel ratio control system according to the invention, will be discussed herebelow with reference to FIGS. 3 to 9. In the following discussion, components of the control unit 100 which are not discussed in the preceding disclosure will be discussed with the functions thereof.

Figure 3:
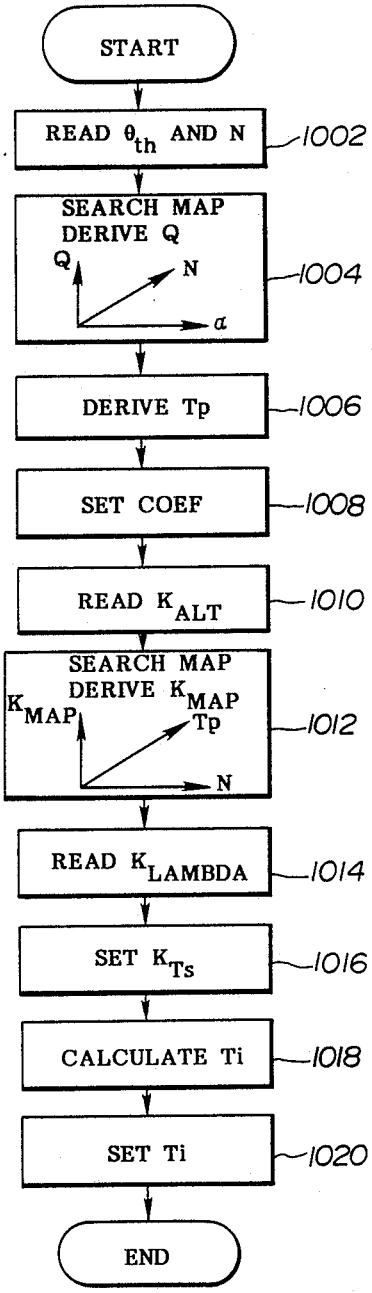
FIG. 3 is a flowchart of a routine for deriving and setting a fuel injection pulse width representative of a fuel injection amount.

FIG. 3 shows a flowchart of a fuel injection pulse setting routine for setting a fuel injection pulse width Ti in the input/output unit 108 of the control unit 100. The fuel injection pulse width Ti setting routine may be triggered at every given timing for updating fuel injection pulse width data Ti in the input/output unit 108.

At a step 1002, the throttle angle indicative signal value $\theta_{th}$ and the engine speed data N are read out. With the throttle angle indicative signal value $\theta_{th}$ and the engine speed data N as read at the step 1002, search is performed against an intake air flow rate map stored in a memory block 130 of ROM 104 to project an intake air flow rate indicative data Q, which map will be hereafter referred to as "Q map", at a step 1004.

In practice, the Q map contains various intake flow rate indicative data Q, each of which data is accessible in terms of the throttle angle indicative signal value $\theta_{th}$ and the engine speed data N. Each of the intake air flow rate indicative data Q is determined through experimentation. Relationship between the throttle angle indicative data $\theta_{th}$, the engine speed data N and the intake air flow rate Q is as shown in the block representing the step 1004.

Based on the engine speed data N as read at the step 1002 and the intake air flow rate indicative data Q as projected at the step 1004, the basic fuel injection amount Tp is derived at a step 1006. Practically, the basic fuel injection amount Tp can be calculated by the following equation:

$$Tp = K \times Q/N$$

where K is constant

At a step 1008, correction coefficients COEF is set. In practice, the correction coefficient COEF to be set here is constituted by an engine coolant temperature dependent component which will be hereafter referred to as "Tw correction coefficient", an engine start-up acceleration enrichment component which will be hereafter referred to as "start-up enrichment correction coefficient", an acceleration enrichment component which will be hereafter referred to as "acceleration enrichment correction coefficient" and so forth. The Tw correction coefficient may be derived on the basis of the engine coolant temperature indicative signal Tw. The start-up enrichment correction coefficient may be derived in response to the ignition switch operated to a cranking position. In addition, the acceleration enrichment correction coefficient can be derived in response to an acceleration demand which may be detected from variation of the throttle angle indicative signal values. Manner of derivation of these correction coefficients are per se well known and unnecessary to be discussed in detail. For example, manner of derivation of the acceleration enrichment coefficient has been disclosed in the co-pending U.S. patent application Ser. No. 115,371, filed on Nov. 2, 1987, assigned to the common assignee to the present invention, for example. The disclosure of the above-identified co-pending U.S. patent application is herein incorporated by reference for the sake of disclosure.

At a step 1010, a correction coefficient $K_{ALT}$ is read out. The correction coefficient $K_{ALT}$ is stored in a given address of memory block 131 in RAM 106 and continuously updated through learning process. This correction coefficient will be applicable for air/fuel ratio control for maintaining the air/fuel ratio of the air/fuel mixture at a stoichiometric value at any engine driving range. Therefore, the correction coefficient $K_{ALT}$ will be hereafter referred to as "learnt uniform correction coefficient". Furthermore, address of the memory block 131 storing the learnt uniform correction coefficient $K_{ALT}$ will be hereafter referred to as "$K_{ALT}$ address". At the initial stage before learning, the learnt uniform correction coefficient $K_{ALT}$ is set at a value "0". After the process at the step 1010, a correction coefficient $K_{MAP}$ is determined by map search in terms of the engine speed indicative data N and the basic fuel injection amount Tp, at a step 1012. In the process of map search, the engine speed indicative data N and the basic fuel injection amount Tp are used as parameters identifying the engine driving range.

A map containing a plurality of mutually distinct correction coefficients $K_{MAP}$ is stored in a memory block 132 RAM 106. This map will be hereafter referred to as "$K_{MAP}$ map". The $K_{MAP}$ map storing memory block 132 is constituted by a plurality of memory addresses each storing individual correction coefficient $K_{MAP}$. Each memory block storing individual correction coefficient $K_{MAP}$ is identified by known address which will be hereafter referred to as "$K_{MAP}$ address". The $K_{MAP}$ address to be accessed is identified in terms of the engine speed indicaiive data N and the basic fuel injection amount Tp. The correction coefficient $K_{MAP}$ stored in each $K_{MAP}$ address is determined in relation to the engine driving range defined by the engine speed data N and the fuel injection amount Tp and continuously updated through learning process. Therefore, this correction coefficient $K_{MAP}$ will be hereafter referred to as "driving range based learnt correction coefficient". Imaginally, the $K_{MAP}$ map is formed by setting the engine speed data N in x-axis and the basic fuel injection amount Tp in y-axis. The x-axis component is divided into a given number $n_N$ of engine speed ranges. Similarly, the y-axis component is divided into a given number $n_{Tp}$ of basic fuel injection ranges. Therefore, the $K_{MAP}$ map is provided ($n_N \times n_{Tp}$) addresses. Practically, the x-axis component and y-axis component are divided into 8 ranges respectively. Therefore, 64 (8×8) addresses are formed to store the driving range based learnt correction coefficient respectively.

It should be noted that each $K_{MAP}$ address in the $K_{MAP}$ initially stores a value "0" before learning process is initiated.

At a step 1014, a feedback correction coefficient $K_{LAMBDA}$ is read out. Process of derivation of the feedback correction coefficient $K_{LAMBDA}$ will be discussed later with reference to FIG. 6. At a step 1016, a battery voltage dependent correction value Ts is set in relation to a voltage of the vehicular battery 21.

Based on the basic fuel injection amount Tp derived at the step 1006, the correction coefficient coefficient COEF derived at the step 1008, the learnt uniform correction coefficient $K_{ALT}$ read at the step 1010, the driving range based learnt correction coefficient $K_{MAP}$ derived at the step 1012, the feedback correction coefficient $K_{LAMBDA}$ read at the step 1014 and the battery voltage dependent correction value Ts set at the step 1016, a fuel injection amount Ti is calculated at a step 1018 according to the following equation $$Ti = Tp \times COEF \times (K_{LAMBDA} + K_{ALT} + K_{MAP}) + Ts$$

A fuel injection pulse width data corresponding to the fuel injection amount Ti derived at the step 1018, which will be hereafter referred to as "Ti data", is set in the input/out unit 108.

Figure 4:
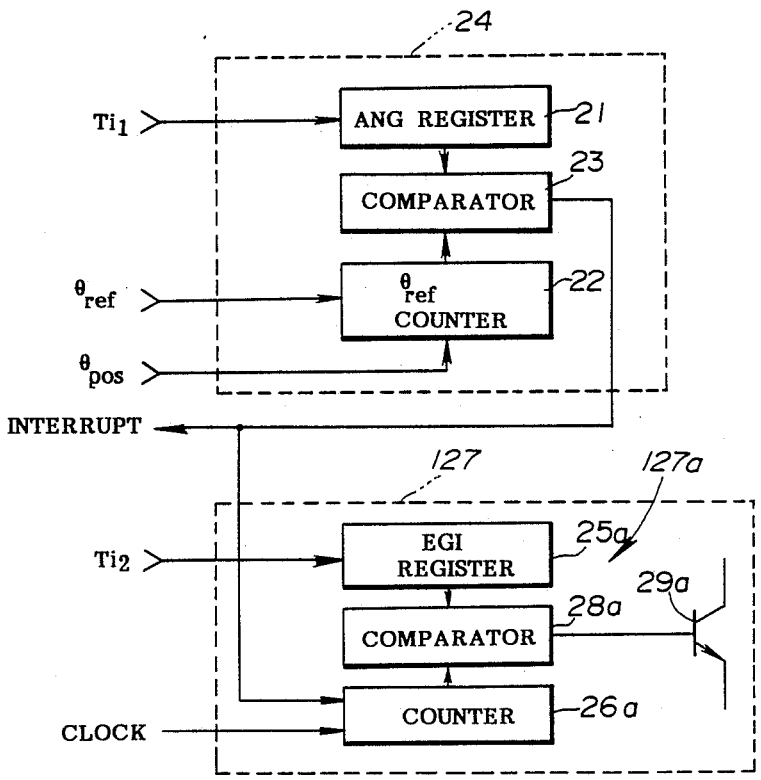
FIG. 4 is a block diagram of an input/output unit in the control unit to be employed in the preferred embodiment of the air/fuel ratio control system of FIG. 2.

FIG. 4 shows one example of construction of part of the input/output unit 108 which is used for controlling fuel injection timing and fuel injection amount according to the set Ti data.

FIG. 4 shows detailed construction of the relevant section of the input/output unit 108. The input output unit 108 has a fuel injection start timing control section 124. The fuel injection start timing control section 124 has an angle (ANG) register 121, to which a fuel injection start timing derived by CPU during process of fuel injection control data, e.g. the air flow rate, throttle angle position, the engine speed and so forth. The fuel injection start timing control section 124 also has a crank position signal counter 122. The crank position signal counter 122 is designed to count up the crank position signals $\theta_{pos}$ and to be reset in response to the crank reference signal $\theta_{ref}$. A comparator 123 is also provided in the fuel injection start timing control section 124. The comparator 123 compares the fuel injection start timing indicative value set in the ANG register 121 and the crank position signal counter value in the counter 122. The comparator 123 outputs HIGH level comparator signal when the crank position signal counter value becomes the same as that of the fuel injection start timing indicative value. The HIGH level comparator signal of the comparator 123 is fed to a fuel injection pulse output section 127.

The fuel injection pulse output section 130 has a fuel injection pulse generator 127*a*. The fuel injection pulse generator 127*a* comprises a fuel injection (EGI) register 125, a clock counter 126, a comparator 128 and a power transistor 129. A fuel injection pulse width data which is determined through data processing during execution of fuel injection control program to be discussed later, is set in the EGI register 125.

The output of the comparator 123 is connected to the clock counter 126. The clock counter 126 is responsive to the leading edge of HIGH level output of the comparator to be reset. On the other hand, the clock counter 126 is connected to a clock generator 112 in the control unit 100 to receive therefrom a clock pulse. The clock counter 126 counts up the clock pulse as triggered by the HIGH level gate signal. At the same time, the comparator 128 is triggered in response to resetting of the clock counter 126 to output HIGH level comparator signal to the base electrode of the power transistor 129. The power transistor 129 is thus turned ON to open the fuel injection valve 6 to perform furl injection.

When the counter value of the clock counter 126 reaches the fuel injection pulse width value set in the EGI register 125, the comparator signal of the comparator 128 turns into LOW level to turn OFF the power transistor 129. By turning OFF of the power transistor 129, the fuel injection valve 4 closes to terminate fuel injection.

The ANG register 121 in the fuel injection start timing control section 124 updates the set fuel injection start timing data at every occurrence of the crank reference signal $\theta_{ref}$.

With this arrangement, fuel injection starts at the timing set in the ANG register 121 and is maintained for a period as set in the EGI register 125. By this, the fuel injection amount can be controlled by adjusting the fuel injection pulse width.

Figure 5:
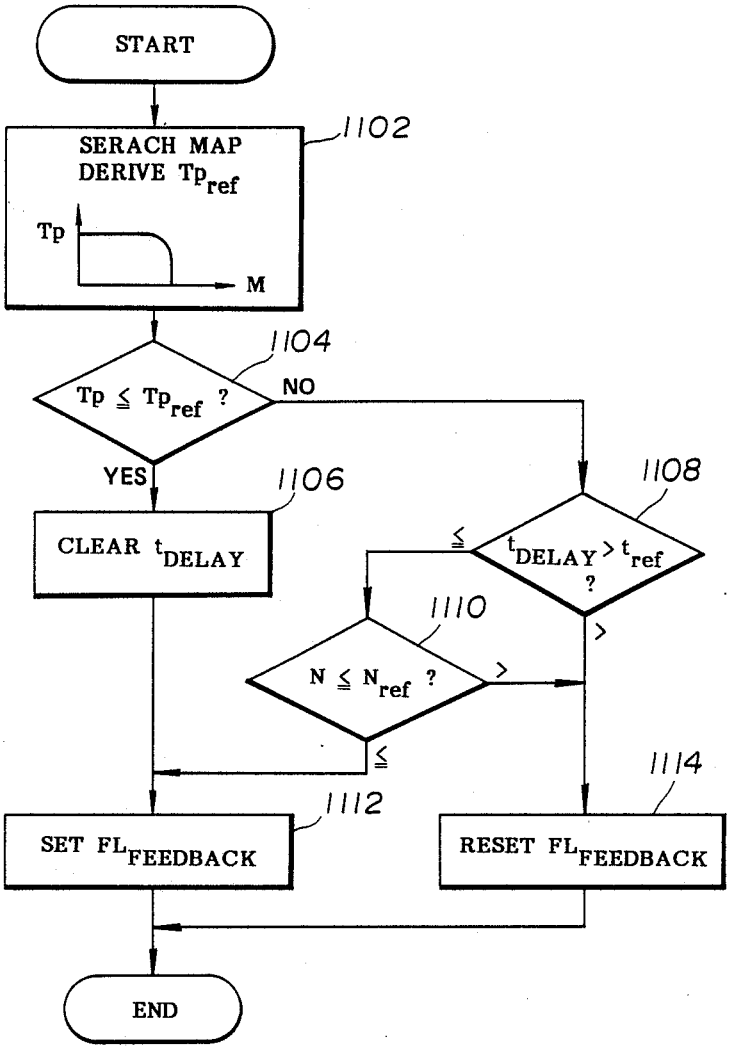
FIG. 5 is a flowchart of a routine for discriminating engine operating condition for governing control operation mode between FEEDBACK control mode and OPEN LOOP control mode.

FIG. 5 shows a routine governing control mode to switch the mode between FEEDBACK control mode and OPEN LOOP control mode based on the engine driving condition. Basically, FEEDBACK control of air/fuel ratio is taken place while the engine is driven under load load and at low speed and OPEN LOOP control is performed otherwise. In order to selectively perform FEEDBACK control and OPEN LOOP control, the basic fuel injection amount Tp is taken as a parameter for detecting the engine driving condition. For distinguishing the engine driving condition, a map containing FEEDBACK condition indicative criteria $Tp_{ref}$ is set in a memory block 133 of ROM 104. The map is designed to be searched in terms of the engine speed N, at a step 1102. The FEEDBACK condition indicative criteria set in the map are experimentarily obtained and define the engine driving range to perform FEEDBACK control, which engine driving range is explaratorily shown by the hutched area of the map illustrated within the process block 1102 of FIG. 5.

At a step 1104, the basic fuel injection amount Tp derived in the process of the step 1006 is then compared with the FEEDBACK condition indicative criterion $Tp_{ref}$, at a step 1104. When the basic fuel injection amount Tp is smaller than or equal to the FEEDBACK condition indicative criterion $Tp_{ref}$ as checked at the step 1104, a delay timer 134 in the control unit 100 and connected to a clock generator 135, is reset to clear a delay timer value $t_{DELAY}$, at a step 1106. On the other hand, when the basic fuel injection amount Tp is greater than the FEEDBACK condition indicative criterion $Tp_{ref}$ as checked at the step 1104, the delay timer value $t_{DELAY}$ is read and compared with a timer reference value $t_{ref}$, at a step 1108. If the delay timer value $t_{DELAY}$ is smaller than or equal to the timer reference value $t_{ref}$, the engine speed data N is read and compared with an engine speed reference $N_{ref}$, at a step 1110. The engine speed reference $N_{ref}$ represents the engine speed criterion between high engine speed range and low engine speed range. Practically, the engine speed reference $N_{ref}$ is set at a value corresponding to a high/low engine speed criteria, e.g. 3800 r.p.m. When the engine speed indicative data N is smaller than the engine speed reference $N_{ref}$, or after the step 1106, a FEEDBACK condition indicative flag $FL_{FEEDBACK}$ which is to be set in a flag register 136 in the control unit 100, is set at a step 1112. When the delay timer value $t_{DELAY}$ is greater than the timer reference value $t_{ref}$, a FEEDBACK condition indicative flag $FL_{FEEDBACK}$ is reset, at a step 1114. After one of the step 1112 and 1114, process goes END and is returned to a background job which governs execution of various routines.

By providing the delay timer to switch mode of control between FEEDBACK control and OPEN LOOP control, hunting in selection of the control mode can be successfully prevented. Furthermore, by providing the delay timer for delaying switching timing of control mode from FEEDBACK control to OPEN LOOP mode, FEEDBACK control can be maintained for the period of time corresponding to the period defined by the timer reference value. This expands period to perform FEEDBACK control and to perform learning.

For example, during hill or mountain climbing, FEEDBACK control can be maintained for the given period corresponding to the set delay time to learning of correction coefficient for adapting the air/fuel ratio to the air density even though the engine driving condition is in transition state.

Figure 6:
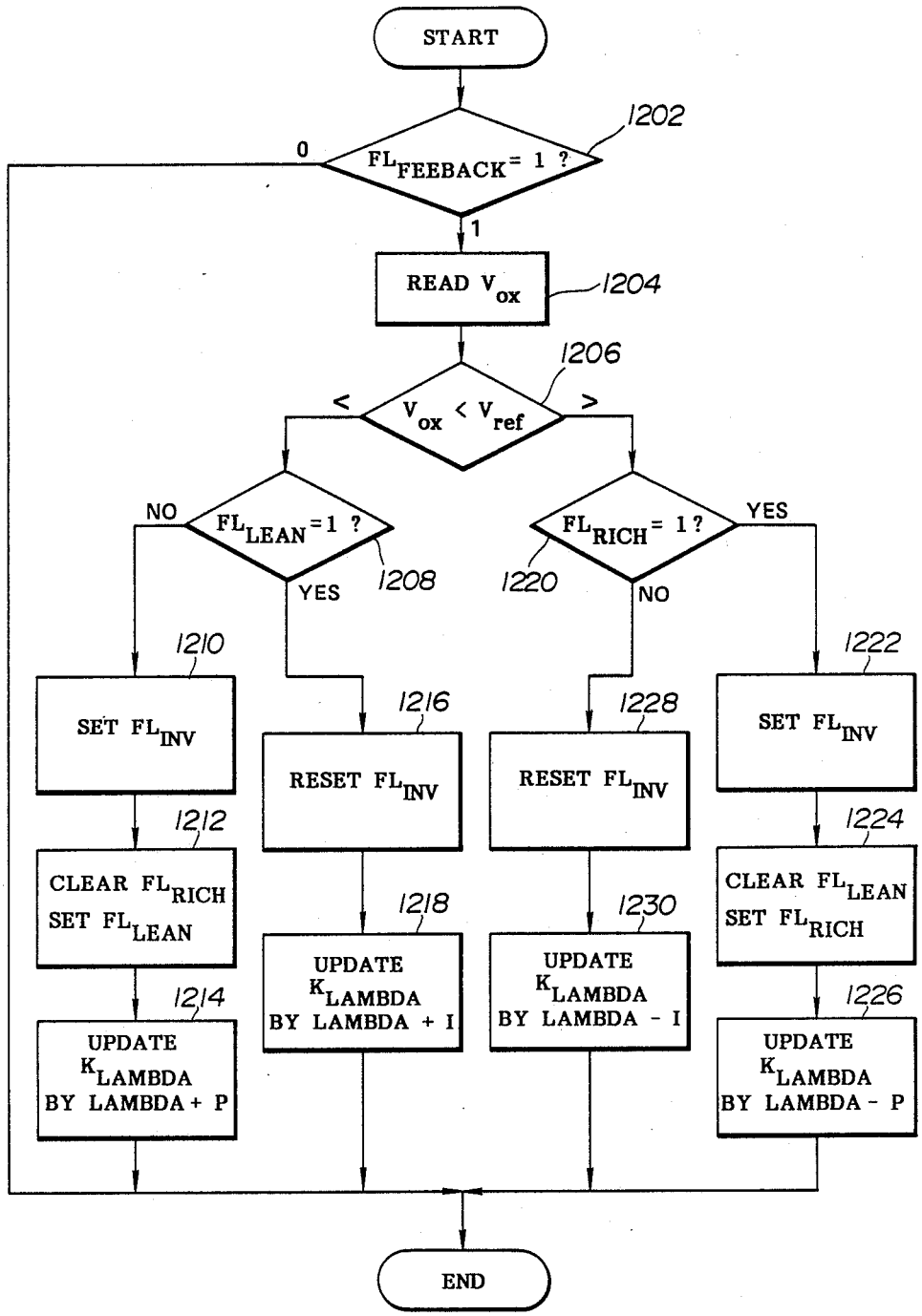
FIG. 6 is a flowchart of a routine for deriving feedback correction coefficient composed of a proportional component and an integral component.

FIG. 6 shows a routine for deriving the feedback correction coefficient $K_{LAMBDA}$. The feedback correction coefficient $K_{LAMBDA}$ is composed of a proportional (P) component and an integral (I) component. The shown routine is triggered every given timing, i. e. every 10 ms., in order to regularly update the feedback control coefficient $K_{LAMBDA}$. The feedback control coefficient $K_{LAMBDA}$ is stored in a memory block 137 and cyclically updated during a period in which FEEDBACK control is performed.

At a step 1202, the FEEDBACK condition indicative flag $FL_{FEEDBACK}$ is checked. When the FEEDBACK condition indicative flag $FL_{FEEDBACK}$ is not set as checked at the step 1202, which indicates that the ongoing control mode is OPEN LOOP. Therefore, process directly goes END. At this occasion, since the feedback correction coefficient $K_{LAMBDA}$ is not updated, the content in the memory block 137 storing the feedback correction coefficient is held in unchanged.

When the FEEDBACK condition indicative flag $FL_{FEEDBACK}$ is set as checked at a step 1202, the oxygen concentration indicative signal $V_{ox}$ from the oxygen sensor 20 is read out at a step 1204. The oxygen concentration indicative signal value $V_{ox}$ is then compared with a predetermined rich/lean criterion $V_{ref}$ which corresponding to the air/fuel ratio of stoichiometric value, at a step 1206. In practice, in the process, judgment is made that the air/fuel mixture is lean when the oxygen concentration indicative signal value $V_{ox}$ is smaller than the rich/lean criterion $V_{ref}$, a lean mixture indicative flag $FL_{LEAN}$ which is set in a lean mixture indicative flag register 138 in the control unit 100, is checked at a step 1208.

When the lean mixture indicative flag $FL_{LEAN}$ is not set as checked at the step 1208, fact of which represents that the air/fuel mixture ratio is adjusted changed from rich to lean, an rich/lean inversion indicative flag $FL_{INV}$ which is set in a flag register 139 in the control unit 100, is set at a step 1210. Thereafter, a rich mixture indicative flag $FL_{RICH}$ which is set in a flag register 139, is reset and the lean mixture indicative flag $FL_{LEAN}$ is set, at a step 1212. Then, the feedback correction coefficient $K_{LAMBDA}$ is modified by adding a proportional constant (P constant). On the other hand, when the lean mixture indicative flag $FL_{LEAN}$ is set as checked at the step 1208, the rich/lean inversion indicative flag $FL_{INV}$ is reset at a step 1216. Thereafter, the feedback correction coefficient $K_{LAMBDA}$ is updated by adding a given integral constant (I constant), at a step 1218.

On the other hand, when the oxygen concentration indicative signal value $V_{ox}$ is greater than the rich/lean criterion $V_{ref}$ as checked at the step 1206, a rich mixture indicative flag $FL_{RICH}$ which is set in a rich micture indicative flag register 141 in the control unit 100, is checked at a step 1220.

When the rich mixture indicative flag $FL_{RICH}$ is not set as checked at the step 1220, fact of which represents that the air/fuel mixture ratio is just changed from lean to rich, an rich/lean inversion indicative flag $FL_{INV}$ which is set in a flag register 139 in the control unit 100, is set at a step 1222. Thereafter, a rich mixture indicative flag $FL_{LEAN}$ is reset and the rich mixture indicative flag $FL_{RICH}$ is set, at a step 1224. Then, the feedback correction coefficient $K_{LAMBDA}$ is modified by subtracting the P constant, at a step 1226. On the other hand, when the rich mixture indicative flag $FL_{RICH}$ is set as checked at the step 1220, the rich/lean inversion indicative flag $FL_{INV}$ is reset at a step 1228. Thereafter, the feedback correction coefficient $K_{LAMBDA}$ is updated by subtracting the I constant, at a step 1230.

After one of the process of the steps 1214, 1218, 1226 and 1230, process goes to the END.

It should be noted that, in the shown embodiment, the P component is set at a value far greater than that of I component.

Figure 7:
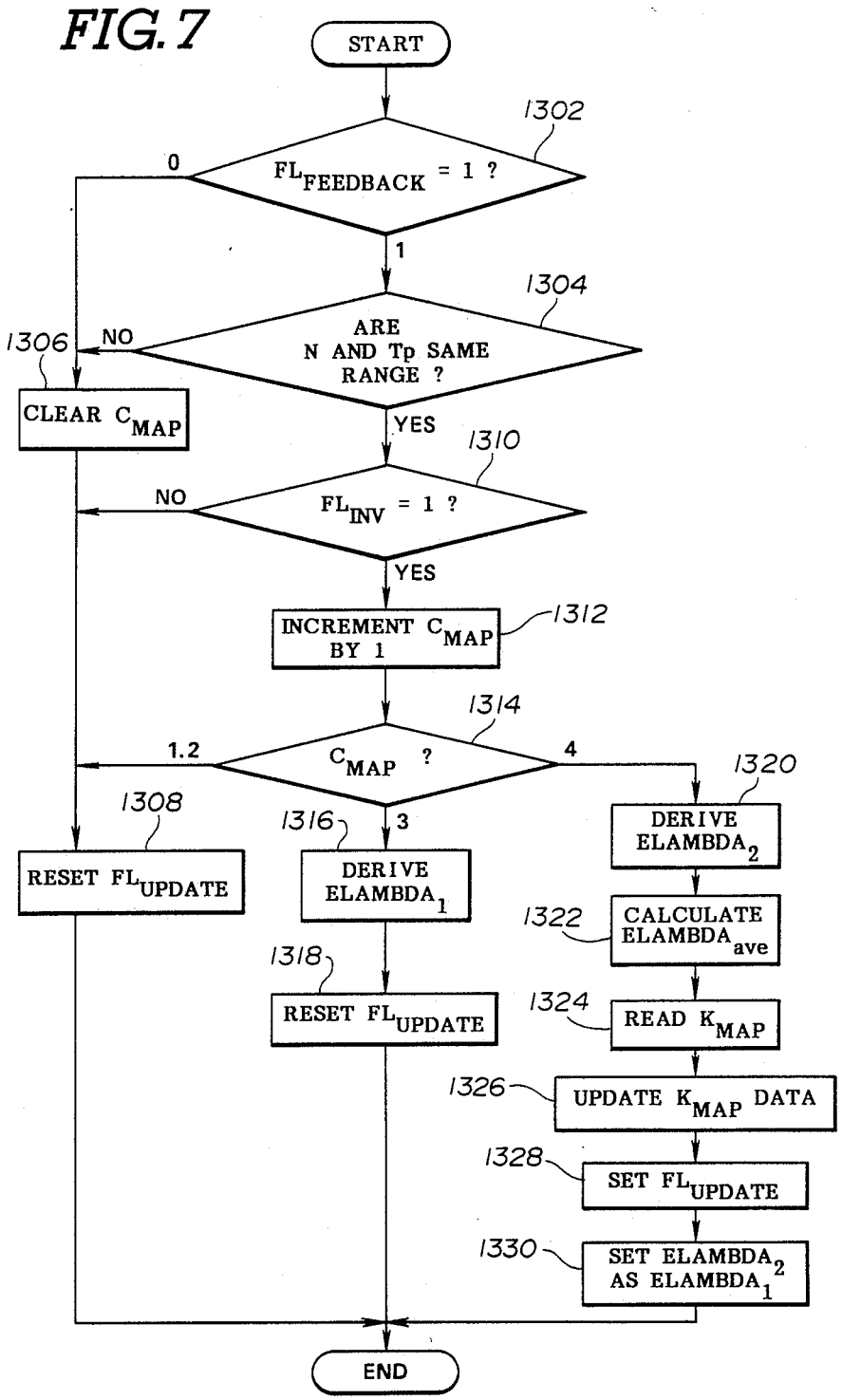
FIG. 7 is a flowchart of a first learning routine for updating a map storing engine driving range based correction coefficients.

FIG. 7 shows a first learning routine for updating the engine driving range based learnt correction coefficient. As set forth above, learning of the correction coefficient is performed only when the control mode is FEEDBACK mode. Therefore, at a step 1302, check is performed whether the FEEDBACK condition indicative flag $FL_{FEEDBACK}$ is set or not. If the FEEDBACK condition indicative flag $FL_{FEEDBACK}$ is set as checked at the step 1302, check is performed whether the engine speed data N and the basic fuel injection amount Tp identifies the same engine driving range as that identified in the former execution cycle, at a step 1304. In practice, check in the step 1304 is performed by comparing the address data identifying corresponding memory block in the $K_{MAP}$ map. The address data identified by the engine speed data N and the basic fuel injection amount Tp is temporarily stored in a memory block 141 of RAM 106. When FEEDBACK condition indicative flag $FL_{FEEDBACK}$ is not set as checked at the step 1302 or when the address data as compared at the step 1304 do no match with the address data stored in the memory block 141 which means that the engine speed data N and the basic fuel injection amount Tp identifies different engine driving range than that identified in the former execution cycle, an updating counter 142 in the control unit 100 is reset to clear a updating counter value $C_{MAP}$, at a step 1306. At a step 1308, an updating indicative flag $FL_{UPDATE}$ to be set in a flag register 140 of the control unit 100, is reset.

On the other hand, when the address data compared the address data stored in the memory block 142 matches with the latter, the inversion indicative flag $FL_{INV}$ is checked at a step 1310. When the inversion indicative flag $FL_{INV}$ is not set as checked at the step 1310, process goes to the step 1308 to reset the updating indicative flag $FL_{UPDATE}$.

When the inversion indicative flag $FL_{INV}$ is set as checked at the step 1310, the updating counter $C_{MAP}$ is incremented by 1, at a step 1312. After this, the updating counter value $C_{MAP}$ is checked at a step 1314. This updating counter $C_{MAP}$ serves to count up occurrence of updating of updating of the feedback correction coefficient $K_{LAMBDA}$ while the engine driving range is held in the one range.

When the updating counter value $C_{MAP}$ is 1 or 2, process goes to the step 1308. On the other hand, when the updating counter value $C_{MAP}$ is 3, a first correction coefficient error value $ELAMBDA_1$ is derived at a step 1316. The first correction coefficient error value ELAMBDA represents a difference between the feedback correction coefficient $K_{LAMBDA}$ and a coefficient reference value $LAMBDA_{ref}$, e.g. 1, and is temporarily stored in a memory block 143 of RAM 106. After this the updating flag $FL_{UPDATE}$ is reset at a step 1318.

After the process at the step 1308 or 1318, process goes END.

Figure 9:
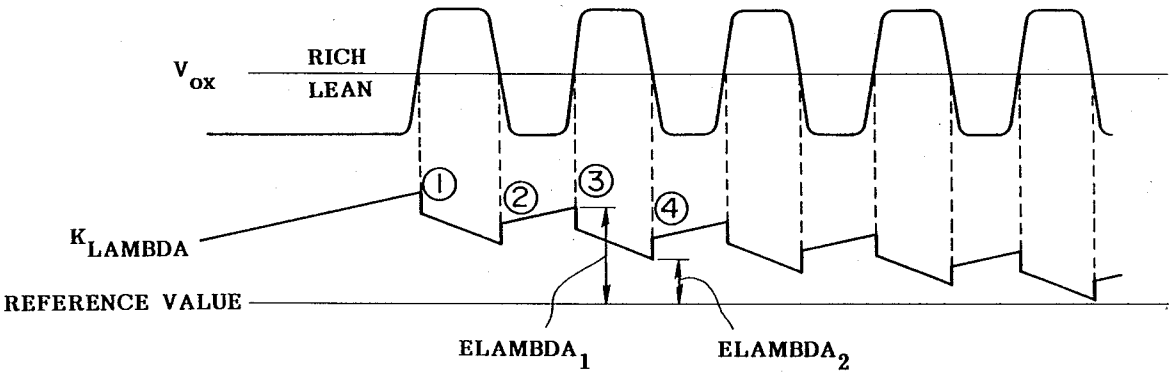
FIG. 9 is a timing chart showing operation of the preferred embodiment of the air/fuel ratio control system of the invention.

It should be appreciated that, as shown in FIG. 9, the first and second correction coefficient error value $ELAMBDA_1$ and $ELAMBDA_2$ represents upper and lower peaks of difference of the feedback correction coefficient $K_{LAMBDA}$ and the reference value, which peak values appear at zero-crossing of the the oxygen concentration indicative signal value $V_{ox}$.

On the other hand, when the updating counter value $C_{MAP}$ is greater than or equal to 4, a second correction coefficient error value $ELAMBDA_2$ is derived on the basis of the instantaneous feedback correction coefficient $K_{LAMBDA}$ and the coefficient reference value $LAMBDA_{ref}$, at a step 1320. An average value $LAMBDA_{ave}$ of the first and second correction coefficient error values $ELAMBDA_1$ and $ELAMBDA_2$ is then calculated at a step 1322.

At a step 1324, the engine driving range based learnt correction coefficient $K_{MAP}$ is read in terms of the engine speed data N and the basic fuel injection value Tp. Based on the average value $LAMBDA_{ave}$ derived at the step 1322, data of the engine driving range based learnt correction coefficient $K_{MAP}$ as read at the step 1324, is modified, at a step 1326. Modification of the engine driving range based correction coefficient $K_{MAP}$ is performed by:

$$K_{MAP}' = K_{MAP} + M_{MAP} \times LAMBDA_{ave}$$

where $K_{MAP}'$ is a modified correction coefficient; and $M_{MAP}$ is a constant determining the correction coefficient $K_{MAP}$ modification rate, which is set in a value range of $0 < M_{MAP} < 1$.

The modified correction coefficient $K_{MAP}'$ is temporarily stored in a temporary register 144. After the step 1326, the updating indicative flag $FL_{UPDATE}$ is set at a step 1328 and the second correction coefficient error value $ELAMBDA_2$ is set in the memory block 143 as the first correction coefficient error value $ELAMBDA_1$ for next cycle of execution, at a step 1330.

By providing the updating counter $C_{MAP}$, updating of the correction coefficient $K_{MAP}$ in the $K_{MAP}$ map is performed only when the learning routine is repeated four cycles or more under substantially the same engine driving condition in the same engine driving range.

Figure 8:
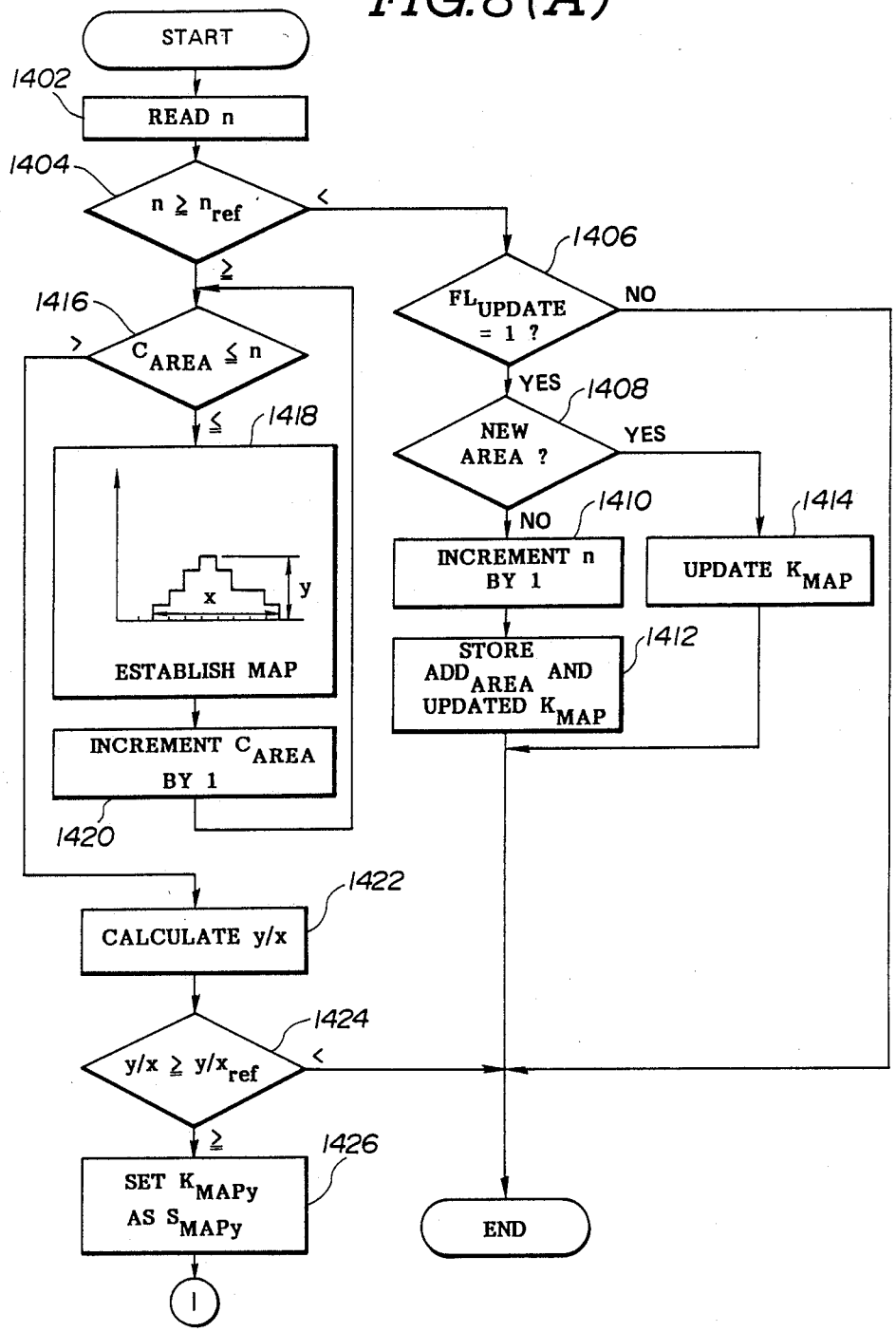
FIGS. 8(A) and 8(B) are flowchart showing a sequence of a second learning routine for updating uniform correction coefficient and engine driving range based correction coefficient.
Figure 8B:
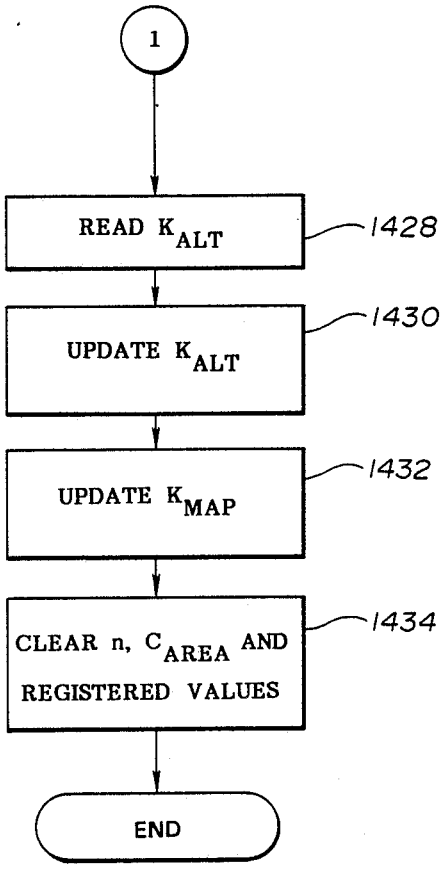

FIGS. 8(A) and 8(B) show a sequence of a second learning routine for updating the learnt uniform correction coefficient and the engine driving range based correction coefficient and for setting an optimum engine driving range based correction coefficient.

At a step 1402, a counter value n of an updated address counter 145 in the control unit 100 is read out. The updated address counter value n is compared with a reference value $n_{ref}$, at a step 1404. When the updated address counter number is smaller than the reference value $n_{ref}$, as checked at the step 1404, the updating indicative flag $FL_{UPDATE}$ is checked at a step 1406. When the updating indicative flag $FL_{UPDATE}$ is not set as checked at the step 1406, process goes to END. On the other hand, when the updating indicative flag $FL_{UPDATE}$ is set as checked at the step 1406, the address of the memory block of $K_{MAP}$ which is updated, is checked whether updating of the correction coefficient in the memory address identified by the address is the first occurrence or not. If the updated address is newly updated address, the updated address counter value n is incremented by 1 at a step 1410. Then, the address data $ADD_{RANGE}$ of the newly updated address and the corresponding engine driving range based correction coefficient data $K_{MAP}'$ as modified at the step 1326 and temporarily stored in the temporary register 144 is stored in the corresponding memory block in the $K_{MAP}$ map, at a step 1412.

On the other hand, when the updated address is the address which was already updated in the preceding execution cycle, the corresponding address of the memory block of the $K_{MAP}$ map is updated by the modified correction coefficient data $K_{MAP}'$ as stored in the temporary register 144, at a step 1414. In the practical operation at the step 1414, the learnt correction coefficient data which is temporarily stored in the temporary register 144 is written in the corresponding address of memory block in the $K_{MAP}$ map. Therefore, the correction coefficient data in the same engine driving range is accumulated in the corresponding address of the $K_{MAP}$ map.

When the updated address counter value n as checked at the step 1404 is greater than or equal to the reference value $n_{ref}$, a value $C_{area}$ of an updated map area counter 146 in RAM 106 is compared with the updated address counter value n at a step 1416. When the updated map area counter value $C_{area}$ is smaller than or equal to the updated address counter value n as checked at the step 1416, distribution of the updated engine driving range based correction coefficient $K_{MAP}$ is checked, at a step 1418. In order to check distribution of the correction coefficient data in each memory area of the $K_{MAP}$ map, a distribution map which is shown in the block of the step 1418 of FIG. 8(A), is formed with respect to each of the map addresses of the $K_{MAP}$ map. In the map illustrated, x-axis represents the correction coefficient data value and y-axis represents number of the address area having the same correction coefficient data values. After all of the correction coefficient data of address areas are plotted, the updated map area counter value $C_{area}$ is incremented by 1, at a step 1420. The process in the steps 1416 through 1420 is repeated until the updated map area counter value $C_{area}$ becomes greater than the updated address counter value n. By formulating the distribution map at the step 1418, memory area in the $K_{MAP}$ map whose number of plots is maximum can be found. This memory area will be hereafter referred to as "maximum plot area" and the number of plots in the maximum plot area is represented by a value "y". On the other hand, the engine driving ranges over which the learnt correction coefficients in the $K_{MAP}$ map are distributed will be hereafter referred to as "updating range". Number of engine driving ranges in the updating range is represented by a value "x". Based on "y" and "x" thus derived, y/x which represents a ration of y versus x and thus represents ratio of maximum occurrence of updating for the maximum plot area versus distribution of engine driving range, at a step 1422. Then, the calculated y/x is compared with a $y/x_{ref}$.

When the x/y value is smaller than $y/x_{ref}$ as checked at the step 1424 is smaller than the $y/x_{ref}$, process goes END. On the other hand, when the y/x value is greater than the $y/x_{ref}$, the correction coefficient value $K_{MAP}$ in the maximum plot area is set as an optimal engine driving range based correction coefficient $SK_{MAP}$, at a step 1426. The optimal engine driving range based correction coefficient $SK_{MAP}$ as derived at the step 1426, stored in a memory block 147 of RAM 106.

Here, the $y/x_{ref}$ is set as a criterion distinguishing the reliable value and unreliable value of the engine driving range based correction coefficient $K_{MAP}$ in the maximum plot area. Namely, when the y/x value is great it means that the plots are concentrated in relatively narrow range and the number of plots in the maximum plot area is sufficiently great to provide sufficient reliability of the value. On the other hand, when the y/x value is small, it means that the plots are distributed over relatively wide engine driving ranges or the number of plots in the maximum plot area is too small to provide sufficient reliability. Therefore, by providing the judgment block 1424, the optimal engine driving range based correction coefficient $SK_{MAP}$ is updated only by the sufficiently reliable value.

At a step 1428, the learnt uniform correction coefficient $K_{ALT}$ is read out from the 131. The read learned uniform correction coefficient $K_{ALT}$ is modified with the optimal engine driving range based correction coefficient $SK_{MAP}$, at a step 1430. In the practical operation, modification of the learned uniform correction coefficient $K_{ALT}$ is performed by adding the optimal engine driving range based correction coefficient $SK_{MAP}$ to the learnt uniform correction coefficient $K_{ALT}$ read at the step 1428. Thereafter, each of the engine driving range based correction coefficients $K_{MAP}$ are modified by subtracting the optimal engine driving range based correction coefficient $SK_{MAP}$, at a step 1432. Thereafter, the updated address counter value n in the updated address counter 145, the updated area counter value $C_{area}$ in the updated area counter 146 and other register values are cleared at a step 1434 and thereafter process goes END.

Through the process set forth above, the learnt correction values can be successfully updated for minimizing lag in FEEDBACK mode air/fuel ratio control and for minimizing deviation of air/fuel ratio from a desired value, e.g. stoichiometric value, during OPEN LOOP mode air/fuel ratio control. Furthermore, in the shown embodiment, since the learnt uniform correction value can be updated to a value essentially corresponding to the instantaneous air density, deviation in the OPEN LOOP control value may substantially correspond to the environmental condition even when the engine is driven in transition range so as not to sufficiently update the engine driving range based correction coefficients.

Therefore, the invention fulfills all of the objects and advantages sought therefor.

It should be appreciated that though the shown embodiment of the air/fuel ratio control system has been directed to a single point injection type fuel injection control system for adjusting the fuel injection amount for adjusting the air/fuel ratio toward the stoichiometric value, it should be possible to apply the same or similar process to a multi-point injection type fuel injection internal combustion engines. Furthermore, in case of the single point injection, the position to dispose the fuel injection valve is not specified to the shown position, i.e. upstream of the throttle chamber but can be any appropriate positions.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention set out in the appended claims.

What is claimed is:

1. An air/fuel ratio control system for controlling a mixture ratio of an air/fuel mixture to be introduced into a combustion chamber in an internal combustion engine, comprising:

an air/fuel mixture induction system for introducing intake air and fuel for forming an air/fuel mixture to be supplied into an engine combustion chamber, said air/fuel mixture delivery system incorporating a fuel metering means for delivering a controlled amount of fuel;

a first sensor means for monitoring a preselected basic first engine operation parameter to produce a first sensor signal indicative thereof;

a second sensor means for monitoring an air/fuel mixture ratio indicative parameter for producing a second sensor signal indicative of a deviation from a threshold value representative of a stoichiometric value;

third means for deriving a basic fuel metering amount on the basis of said first sensor signal value;

fourth means for deriving a air/fuel ratio dependent correction factor depending upon said second sensor signal value;

fifth means for deriving a correction coefficient for air/fuel ratio independent correction of said basic fuel metering amount which correction coefficient includes a first component which is commonly applicable for correction of said basic fuel metering amount over all engine driving ranges and a second component containing a plurality of mutually distinct individual correction coefficient indicative values respectively set with respect to corresponding engine driving ranges, said fifth means detecting an instantaneous engine driving range on the basis of said first sensor signal value and deriving said individual correction coefficient indicative values based on said correction factor and updating previously set ones of individual correction coefficient indicative values corresponding to detected engine driving ranges, said fifth means cyclically deriving an updating value for said first component based on said individual correction coefficient indicative values and updating the latter with said updating value; and a sixth means for correcting said basic fuel metering amount with said correction coefficient to control said fuel metering means for delivering the fuel in the amount corresponding to the corrected fuel metering amount to said air/fuel mixture delivery system.

2. An air/fuel ratio control system as set forth in claim 1, which further comprises a detector means detective of engine driving condition satisfying a predetermined feedback control condition for producing a feedback condition indicative signal, said fifth means operates in feedback mode for correcting said basic fuel metering amount with said first and second components of said correction coefficient and operates in open loop mode for correcting said basic fuel metering amount with said first component when said feedback condition indicative signal is absent.

3. An air/fuel ratio control system as set forth in claim 2, wherein said fourth means is active in presence of said feedback condition indicative signal to cyclically derive said correction factor, and said fifth means is active for deriving said individual correction coefficient indicative value on the basis of said correction factor only when said feedback condition indicative signal is present.

4. An air/fuel ratio control system as set forth in claim 1, wherein said correction factor is composed of a proportional component and an integral component, and said fourth means adjusts said proportional component and said integral component is adjusted on the basis of the value of said second sensor signal value for adjusting the air/fuel ratio of the air/fuel mixture at a stoichiometric value represented by said threshold value.

5. An air/fuel ratio control system set forth in claim 4, wherein said fourth means adjusts said proportional component only when said second sensor signal value varies across said threshold value and otherwise adjusts said integral component.

6. An air/fuel ratio control system for controlling a mixture ratio of an air/fuel mixture to be introduced into a combustion chamber in an internal combustion engine, comprising:

an air/fuel mixture induction system for introducing intake air and fuel for forming an air/fuel mixture to be supplied into an engine combustion chamber, said air/fuel mixture delivery system incorporating a fuel metering means for delivering a controlled amount of fuel;

a first sensor means for monitoring a preselected basic first engine operation parameter to produce a first sensor signal indicative thereof;

a second sensor means for monitoring an air/fuel mixture ratio indicative parameter for producing a second sensor signal indicative of a deviation from a threshold value representative of a stoichiometric value;

third means for deriving a basic fuel metering amount on the basis of said sensor signal value;

fourth means for deriving a air/fuel ratio dependent correction factor depending upon said second sensor signal value;

fifth means for deriving a correction coefficient for air/fuel ratio dependent correction of said basic fuel metering amount which correction coefficient includes a first component which is commonly applicable for correction of said basic fuel metering amount over all engine driving ranges and a second component containing a plurality of mutually distinct individual correction coefficient indicative values respectively set with respect to corresponding engine driving ranges, said fifth means detecting an instantaneous engine driving range on the basis of said first sensor signal value and deriving said individual correction coefficient indicative values based on said correction factor for updating previously set ones of individual correction coefficient indicative values corresponding to detected engine driving ranges, said fifth means cyclically deriving an updating value for said first component and updating the latter with said updating value;

a sixth means for correcting said basic fuel metering amount with said correction coefficient to control said fuel metering means for delivering the fuel in the amount corresponding to the corrected fuel metering amount to said air/fuel mixture delivery system;

a detector means for detecting an engine driving condition satisfying a predetermined feedback control condition for producing a feedback condition indicative signal, said fifth means being operative in a feedback mode for correcting said basic fuel metering amount with said first and second components of said correction coefficient and operates in open loop mode for correcting said basic fuel metering amount with said first component when said feedback condition indicative signal is absent;

wherein said fourth means is active in presence of said feedback condition indicative signal to cyclically derive said correction factor, and said fifth means is active for deriving said individual correction coefficient indicative value on the basis of said correction factor only when said feedback condition indicative signal is present and wherein said fourth means samples upper and lower peak values of said second sensor signal value for deriving said correction factor by averaging said upper and lower peak values.

7. An air/fuel ratio control system as set forth in claim 6, wherein said third means operates cyclically and derives said correction factor when the engine driving range is held at one of the ranges over a predetermined cycles.

8. An air/fuel ratio control system as set forth in claim 7, wherein said third means incorporates a counter means counting up occurrece of variation of said second sensor signal value across said threshold value during the period in which the engine driving range is held at one of the ranges and responsive to the counter value of said counter means greater than a given value to derive said correction factor.

9. An air/fuel ratio control system as set forth in claim 8, wherein said third means is responsive to change of said engine driving range for clearing said counter value.

10. An air/fuel ratio control system for controlling a mixture ratio of an air/fuel mixture to be introduced into a combustion chamber in an internal combustion engine, comprising:

an air/fuel mixture induction system for introducing intake air and fuel for forming an air/fuel mixture to be supplied into an engine combustion chamber, said air/fuel mixture delivery system incorporating a fuel metering means for delivering a controlled amount of fuel;

a first sensor means for monitoring a preselected basic first engine operation parameter to produce a first sensor signal indicative thereof;

a second sensor means for monitoring an air/fuel mixture ratio indicative parameter for producing a second sensor signal indicative of a deviation from a threshold value representative of a stoichiometric value;

third means for deriving a basic fuel metering amount on the basis of said first sensor signal value;

fourth means for deriving a air/fuel ratio dependent correction factor depending upon said second sensor signal value;

fifth means for deriving a correction coefficient for air/fuel ratio dependent correction of said basic fuel metering amount which correction coefficient includes a first component which is commonly applicable for correction of said basic fuel metering amount over all engine driving ranges and a second component containing a plurality of mutually distinct individual correction coefficient indicative values respectively set with respect to corresponding engine driving ranges, said fifth means detecting an instantaneous engine driving range on the basis of said first sensor signal value and deriving said individual correction coefficient indicative values based on said correction factor for updating previously set ones of individual correction coefficient indicative values corresponding to detected engine driving ranges, said fifth means cyclically deriving an updating value for said first component and updating the latter with said updating value; and a sixth means for correcting said basic fuel metering amount with said correction coefficient to control said fuel metering means for delivering the fuel in the amount corresponding to the corrected fuel metering amount to said air/fuel mixture delivery system;

wherein said first sensor means monitors an engine speed indicative parameter and an engine load indicative parameter so that said third means derives said basic fuel metering amount of the basis of said engine speed indicative parameter and said engine load indicative parameter, and said fifth means detects said engine driving range on the basis of said engine speed and said basic fuel metering amount.

11. An air/fuel ratio control system as set forth in claim 10, wherein said first sensor means monitors a throttle valve angular position and derives said engine load indicative parameter on the basis of said throttle valve angular position and said engine speed.

12. An air/fuel ratio control system for controlling a mixture ratio of an air/fuel mixture to be introduced into a combustion chamber in an internal combustion engine, comprising:

an air/fuel mixture induction system for introducing intake air and fuel for forming an air/fuel mixture to be supplied into an engine combustion chamber, said air/fuel mixture delivery system incorporating a fuel metering means for delivering a controlled amount of fuel;

a first sensor means for monitoring a preselected basic first engine operation parameter to produce a first sensor signal indicative thereof;

a second sensor means for monitoring an air/fuel mixture ratio indicative parameter for producing a second sensor signal indicative of a deviation from a threshold value representative of a stoichiometric value;

third means for deriving a basic fuel metering amount on the basis of said first sensor signal value;

fourth means for deriving a air/fuel ratio dependent correction factor depending upon said second sensor signal value;

fifth means for deriving a correction coefficient for air/fuel ratio dependent correction of said basic fuel metering amount which correction coefficient includes a first component which is commonly applicable for correction of said basic fuel metering amount over all engine driving ranges and a second component containing a plurality of mutually distinct individual correction coefficient indicative values respectively set with respect to corresponding engine driving ranges, said fifth means detecting an instantaneous engine driving range on the basis of said first sensor signal value and deriving said individual correction coefficient indicative values based on said correction factor for updating previously set ones of individual correction coefficient indicative values corresponding to detected engine driving ranges, said firth means cyclically deriving an updating value for said first component and updating the latter with said updating value;

a sixth means for correcting said basic fuel metering amount with said correction coefficient to control said fuel metering means for delivering the fuel in the amount corresponding to the corrected fuel metering amount to said air/fuel mixture delivery system; and a detector means for detecting an engine driving condition satisfying a predetermined feedback control condition for producing a feedback condition indicative signal, said fifth means being operative in a feedback mode for correcting said basic fuel metering amount with said first and second components of said correction coefficient and operates in open loop mode for correcting said basic fuel metering amount with said first component when said feedback condition indicative signal is absent;

wherein said first sensor means monitors an engine speed indicative parameter based on which an engine speed data is derived, and an engine load indicative parameter so that said third means derives said basic fuel metering amount on the basis of said engine speed indicative parameter and said engine load indicative parameter, and said firth means detects said engine driving range on the basis of said engine speed data and said basic fuel metering amount.

13. An air/fuel ratio control system as set forth in claim 12, wherein said detector means derives a reference value in terms of said engine speed data to be compared with said basic fuel metering amount for detecting the engine driving condition satisfying said feedback condition when said basic fuel metering amount is smaller than said reference value.

14. An air/fuel ratio control system as set forth in claim 13, which further comprises a timer means triggered by detection of open loop condition to switch control mode from feedback mode control to open loop mode control for providing delay in switching control mode from feedback mode control to open loop control. for adjusting the air/fuel ratio of the air/fuel mixture at a stoichiometric value represented by said threshold value.

15. An air/fuel ratio control system for controlling a mixture ratio of an air/fuel mixture to be introduced into a combustion chamber in an internal combustion engine, comprising:

an air/fuel mixture induction system for introducing an intake air and a fuel for forming an air/fuel mixture to be supplied into an engine combustion chamber, said air/fuel mixture delivery system incorporating a fuel metering means for delivering a controlled amount of fuel;

a first sensor means for monitoring a preselected basic first engine operation parameter to produce a first sensor signal indicative thereof;

a second sensor means for monitoring an air/fuel mixture ratio indicative parameter for producing a second sensor signal variable of the value indicative of a deviation from a threshold value representative of a stoichiometric value;

third means for deriving a basic fuel metering amount on the basis of said first sensor signal value;

fourth means for deriving a air/fuel ratio dependent correction factor variable of the value thereof depending upon said second sensor signal value;

fifth means for deriving a correction coefficient for air/fuel ratio dependent correction of said basic fuel metering amount which correction coefficient including a first component which is commonly applicable for correction of said basic fuel metering amount over all engine driving ranges and a second component containing a plurality of mutually distinct individual correction coefficient indicative values respectively set with respect to corresponding engine driving range, said fifth means detecting an instantaneous engine driving range on the basis of said first sensor signal value and deriving said individual correction coefficient based on said correction factor for updating previously set one of individual correction coefficient indicative values corresponding to detecting engine driving range, said fifth means deriving an updating value for said first component with a predetermined updating interval on the basis of individual correction coefficient indicative values occurring in said updating interval and distribution thereof over various engine driving range and updating the latter with said updating value; and a sixth means for correcting said basic fuel metering amount with said correction coefficient to control said fuel metering means for delivering the fuel in the amount corresponding to the corrected fuel metering amount to said air/fuel mixture delivery system.

16. An air/fuel ratio control system as set forth in claim 15, which further comprises a detector means detective of engine driving condition satisfying a predetermined feedback control condition for producing a feedback condition indicative signal, said fifth means operates in feedback mode for correcting said basic fuel metering amount with said first and second components of said correction coefficient and operates in open loop mode for correcting said basic fuel metering amount with said first component when said feedback condition indicative signal is absent.

17. An air/fuel ratio control system as set forth in claim 16, wherein said fourth means is active in presence of said feedback condition indicative signal to cyclically derive said correction factor, and said fifth means is active for deriving said individual correction coefficient indicative value on the basis of said correction factor only when said feedback condition indicative signal is present.

18. An air/fuel ratio control system as set forth in claim 17, wherein said fourth means samples upper and lower peak values of said second sensor signal value for deriving said correction factor by averaging said upper and lower peak values.

19. An air/fuel ratio control system as set forth in claim 18, wherein said third means operates cyclically and derives said correction factor when the engine driving range is held at one of the ranges over a predetermined cycles.

20. An air/fuel ratio control system as set forth in claim 19, wherein said third means incorporates a counter means counting up occurrence of variation of said second sensor signal value across said threshold value during the period in which the engine driving range is held at one of the ranges and responsive to the counter value of said counter means greater than a given value to derive said correction factor.

21. An air/fuel ratio control system as set forth in claim 20, wherein said third means is responsive to change of said engine driving range for clearing said counter value.

22. An air/fuel ratio control system as set forth in claim 15, wherein said first sensor means monitors an engine speed indicative parameter and an engine load indicative parameter so that said third means derives said basic fuel metering amount on the basis of said engine speed indicative parameter and said engine load indicative parameter, and said fifth means detects said engine driving range on the basis of said engine speed and said basic fuel metering amount.

23. An air/fuel ratio control system as set forth in claim 22, wherein said first sensor means monitors a throttle valve angular position and derives said engine load indicative parameter on the basis of said throttle valve angular position and said engine speed.

24. An air fuel ratio control system as set forth in claim 23, wherein said first sensor means monitors an engine speed indicative parameter based on which an engine speed data is derived, and an engine load indicative parameter so that said third means derives said basic fuel metering amount on the basis of said engine speed indicative parameter and said engine load indicative parameter, and said fifth means detects said engine driving range on the basis of said engine speed data and said basic fuel metering amount.

25. An air/fuel ratio control system as set forth in claim 24, wherein said detector means derives a reference value in terms of said engine speed data to be compared with said basic fuel metering amount for detecting the engine driving condition satisfying said feedback condition when said basic fuel metering amount is smaller than said reference value.

26. An air/fuel ratio control system as set forth in claim 25, which further comprises a timer means triggered by detection of open loop condition to switch control mode from feedback mode control to open loop mode control for providing delay in switching control mode from feedback mode control to open loop control.

27. An air/fuel ratio control system as set forth in claim 26, wherein said correction factor is composed of a proportional component and an integral component, and said fourth means adjusts said proportional component and said integral component is adjusted on the basis of the value of said second sensor signal value for adjusting the air/fuel ratio of the air/fuel mixture at a stoichiometric value represented by said threshold value.

28. An air/fuel ratio control system as set forth in claim 27, wherein said fourth means adjusts said proportional component only when said second sensor signal value varies across said threshold value and otherwise adjusts said integral component.

29. An air/fuel ratio control system for an internal combustion engine comprising:

an air/fuel mixture delivery system for introducing an intake air and a fuel for forming an air/fuel mixture for an engine combustion chamber, said air/fuel mixture delivery system incorporating a fuel metering means for delivering a controlled amount of fuel;

a first sensor means for monitoring a preselected basic first engine operation parameter to produce a first sensor signal indicative thereof;

a second sensor means for monitoring an air/fuel mixture ratio indicative parameter for producing a second sensor signal variable of the value indicative of a deviation from a threshold value representative of a stoichiometric value;

third means for deriving a basic fuel metering amount on the basis of said first sensor signal value;

fourth means for deriving a first correction coefficient for correcting said basic fuel injection amount on the basis of said second sensor means fifth means for deriving a second correction coefficient which is composed of a first common component constituted by a single correction coefficient and a second individual component constituted of a plurality of mutually distinct correction coefficients adapted for respectively different engine driving range;

a sixth means for correcting said basic fuel metering amount by said second correction coefficients to control said fuel metering means for delivering the fuel in the amount corresponding to the corrected fuel metering amount to said air/fuel mixture delivery system;

a seventh means for detecting the engine driving range on the basis of said first sensor signal value and updating corresponding one of correction coefficient in said second individual component and set with respect to detected engine driving range, in relation to said first correction coefficient; and eighth means for modifying said first common component of said second correction coefficient with most frequently occurring one of correction coefficient in said second individual component, at a given timing.

30. An air/fuel ratio control system as set forth in claim 29, which further comprises a detector means detective of engine driving condition satisfying a predetermined feedback control condition for producing a feedback condition indicative signal, said sixth means performs feedback mode air/fuel ratio control by deriving said fuel delivery amount on the basis of said basic fuel metering amount and said first correction coefficient and first and second components of said second correction coefficient under presence of said feedback condition indicative signal and performs open loop mode air/fuel ratio control on the basis of said basic fuel metering amount and said first correction coefficient when said feedback condition indicative signal is absent.

31. An air/fuel ratio control system as set forth in claim 30, wherein said seventh means is active during said feedback mode air/fuel ratio control in which said first correction coefficient is cyclically determined on the basis of said second sensor signal value, for updating said second individual component of said second correction coefficient.

32. An air/fuel ratio control system as set forth in claim 29, wherein said first sensor means monitors an engine speed indicative parameter and an engine load indicative parameter so that said third means derives said basic fuel metering amount on the basis of said engine speed indicative parameter and said engine load indicative parameter, and said seventh means detects said engine driving range on the basis of said engine speed and said basic fuel metering amount.

33. An air/fuel ratio control system as set forth in claim 32, wherein said first sensor means monitors a throttle valve angular position and derives said engine load indicative parameter on the basis of said throttle valve angular position and said engine speed.

34. An air fuel ratio control system as set forth in claim 30, wherein said first sensor means monitors an engine speed indicative parameter based on which an engine speed data is derived, and an engine load indicative parameter so that said third means derives said basic fuel metering amount on the basis of said engine speed indicative parameter and said engine load indicative parameter, and said seventh means detects said engine driving range on the basis of said engine speed data and said basic fuel metering amount.

35. An air/fuel ratio control system as set forth in claim 34, wherein said detector means derives a reference value in terms of said engine speed data to be compared with said basic fuel metering amount for detecting the engine driving condition satisfying said feedback condition when said basic fuel metering amount is smaller than said reference value.

36. An air/fuel ratio control system as set forth in claim 35, which further comprises a timer means triggered by detection of open loop condition to switch control mode from feedback mode control to open loop mode control for providing delay in switching control mode from feedback mode control to open loop control.

37. An air/fuel ratio control system as set forth in claim 29, wherein said first correction coefficient is composed of a proportional component and an integral component, and said fourth means adjusts said proportional component and said integral component is adjusted on the basis of the value of said air/fuel ratio indicative parameter for adjusting the air/fuel ratio of the air/fuel mixture at a stoichiometric value.

38. An air/fuel ratio control system as set forth in claim 37, wherein said fourth means adjusts said proportional component only when said air/fuel ratio indicative signal value varies across said threshold value and otherwise adjusts said integral component.

* * * * *